United States Patent [19]

Suter

[11] Patent Number: 4,598,264

[45] Date of Patent: Jul. 1, 1986

[54] LOCKING MECHANISM FOR A MUTUAL MECHANICAL INTERLOCKING OF TWO ADJOINING SWITCH APPARATUSES

[75] Inventor: Heinz Suter, Aarau, Switzerland

[73] Assignee: Sprecher & Schuh AG, Aarau, Switzerland

[21] Appl. No.: 672,109

[22] Filed: Nov. 15, 1984

[30] Foreign Application Priority Data

Nov. 21, 1983 [CH] Switzerland ..... 6230/83

[51] Int. Cl.[4] ..... H01H 9/20

[52] U.S. Cl. .....335/161; 335/160; 200/50C

[58] Field of Search ..... 335/159, 160, 161, 132, 335/131, 50 C

[56] References Cited

U.S. PATENT DOCUMENTS 3,243,547 3/1969 Jelley ..... 335/160

FOREIGN PATENT DOCUMENTS 2940043 4/1981 Fed. Rep. of Germany .

*Primary Examiner*—Harold Broome

*Attorney, Agent, or Firm*—Ladas & Parry

[57] ABSTRACT

Two similar switch apparatuses are mounted in switching direction at equidirectional closing direction onto a base. Each apparatus has an extension which is movable together with the armature of the corresponding apparatus and which extends in a respective L-coulisse of a two-armed lever placed on a stub shaft of a casing of one of the switch apparatuses to pivot thereabout. If one of the switch apparatuses carries out its switch closing operation, its extension moves in a path section of the coulisse at an acute angle relative to the direction of radius, causing a counterclockwise pivoting movement of the lever. Conclusively, the extension of the other switch apparatus will be caused to be located into a path section of its coulisse extending circularly around the stub such that the latter extension is blocked, preventing a switching movement. The extremely simple design and the equidirectional position of the switch apparatuses allows an economically advantageous arrangement and mounting and prevents a mixup or confusion when connecting the switch apparatuses. Furthermore an exclusively mechanical interlocking of a switch apparatus is possible already at the beginning of the switching movement of the other apparatus such that the holding force of the magnets is practically meaningless.

5 Claims, 3 Drawing Figures

LOCKING MECHANISM FOR A MUTUAL MECHANICAL INTERLOCKING OF TWO ADJOINING SWITCH APPARATUSES

BACKGROUND OF THE INVENTION

1. Field of the Invention

The present invention relates to a locking mechanism for a mutual mechanical interlocking of two switch apparatuses mounted in succession in a directly adjoining manner relative to their direction of switching movement, each apparatus having a casing, an armature and an outwards projecting extension movable by the armature during the switching operation of its switch apparatus, which extensions of the two apparatuses are operatively interconnected by a locking member.

2. Description of the Prior Art

The German published patent application DE-OS No. 29 40 433 discloses a mechanically operating locking mechanism for slider switch apparatuses, in which these apparatuses are arranged in opposite switch closing direction relative to each other. The locking force is provided merely by the holding force of a magnet such that with minimal forces a safe locking is not guaranteed. A further drawback of the design is that the two switch apparatuses must be mounted or arranged, respectively, such that they operate in opposite directions which may give rise to confusions and mixups.

SUMMARY OF THE INVENTION

Hence, it is an object of the present invention to provide an economically advantageous locking mechanism incorporating a high locking security and is not prone to mixups and confusions.

A further object of the invention is to provide a locking mechanism in which the two switch apparatuses are arranged at an equidirectional closing direction of movement of their armature, in which the locking members comprise a two-armed lever which is pivotable about a pivot axis and is provided at both lever arms with one each of two reciprocably equidirectional L-shaped coulisses receiving each one of said extensions in a limited movable manner, whereby upon a closing movement of one of said switch apparatuses its extension enters into one path section of its coulisse, pivots said lever around its pivot axis causing the other extension to enter into a path section of its coulisse extending at least at such time perpendicularly to said direction of switching movement.

The locking mechanism in accordance with the invention allows that two switch apparatuses which are at least approximately similar, such as relays, magnetic switches, can be mounted in a same mutual alignment onto a rail or a base plate adjoining each other following in that contrary to the initially mentioned known design the danger of a mixup or confusion of connections and checking procedures is banned. Due to the exceedingly simple design the structure has a low manufacturing cost and such as will be disclosed in detail further below it allows a fast and safe mounting. Due to the perpendicularly extending path section of the coulisse the locking force depends exclusively on the mechanical strength of the corresponding structural members, however in no instance on the holding force of the holding magnet. Conclusively no malfunctions can occur.

According to one embodiment one path section of each coulisse is designed such that it extends along a circle extending around the pivot axis of the lever. This embodiment guarantees a frictionless pivoting of the lever without any disturbance by the switch apparatus being locked whereby, however, the extension of this switch apparatus safely locks mechanically immediately after the start of the switching operation the other switch apparatus and is prevented from carrying out a switching movement.

The movement of the lever by means of the extension of the switch apparatus carrying out the switching operation can proceed in a refined manner by the path section of the corresponding coulisse extending at an acute angle relative to the direction of the radius of the lever operating in accordance with the effect of an inclined plane.

According to a further embodiment the lever is plugged over a stub shaft integrally formed on a casing wall and preferably at the bottom wall of the casing of the apparatus. In order to prevent the lever from falling down it can be held by a covering. This covering in turn is preferably clamped in an easy manner between the corresponding casing wall and a base (rail or plate) serving as common mounting base for the two switch apparatuses.

In order to prevent obstructions when using such a switch apparatus, for instance a relay, in different applications by projecting structural members an embodiment of the invention foresees an extension projecting out of the casing which is releasably mounted such that depending on a specific application it can be left away or plugged on through an opening provided in the corresponding wall of the casing. This increases also the versatile use of the switch apparatuses and accordingly the economics of the inventive mechanism.

The assembly of a mechanism designed in accordance with the present invention can proceed in a preferred embodiment such as follows. An extension each is set in at the corresponding housing wall, which extension can be plugged onto the structural member interconnecting the extension with the armature. The switch apparatuses are arranged in an equidirectional manner directly adjoinging each other and thereafter the lever is plugged onto a stub of a casing wall (of one of the two casings) and accordingly the extensions will project and enter into the respective corresponding coulisse. Thereafter the covering is placed thereupon and the two switch apparatuses are mounted onto a common base. If considered necessary, the function of the switch apparatuses can be checked by a mechanical operation thereof by means of corresponding manual measures.

BRIEF DESCRIPTION OF THE DRAWINGS

The present invention will be more fully understood by reference to the following detailed description thereof when read in conjunction with the attached drawings, and wherein.

DESCRIPTION OF THE PREFERRED EMBODIMENT

Figure 1:
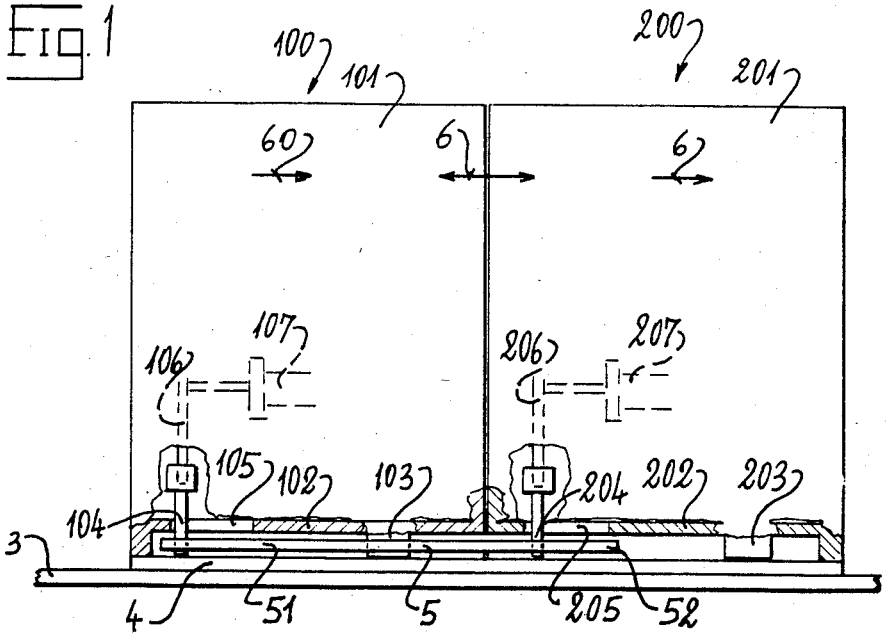
FIG. 1 is a schematical side view of a preferred embodiment with some areas shown in section.

The two switch apparatuses 100 and 200 are mounted adjacently on a base 3. The casings 101 and 201 of the two switch apparatuses may hereby be mounted in a generally known way on a base 3 having the shape e.g. of a rail or a plate.

A covering 4 is located between the bottom 102 and 202, respectively, of the casings 101 and 201, respectively and the base 3, which covering 4 prevents the lever 5 from gliding off of the stub 103 of the casing bottom 102. Because the two switch apparatuses are basically of an identical design, the casing bottom 202 is also provided with a stub 203. The latter stub 203 could act as axis for the lever 5 in place of stub 103 if the switch apparatuses are correspondingly mutually placed.

In the two lever arms 51 and 52 two L-shaped equidirectional coulisses 510 and 520, respectively, are provided, which coulisses receive each an extension 104 and 204, respectively, of the switch apparatuses 100 and 200, respectively. These extensions extend through slots 105 and 205, respectively, in the casing bottoms 102 and 202, respectively, and are plugged onto a member 106 and 206, respectively, which during a switching movement of the switch apparatuses 100 and 200, respectively, are moved by their corresponding armature 107 and 207, respectively.

The two switch apparatuses are mounted for a equidirectional switching movement 6 and switch closing direction 60.

Figure 2:
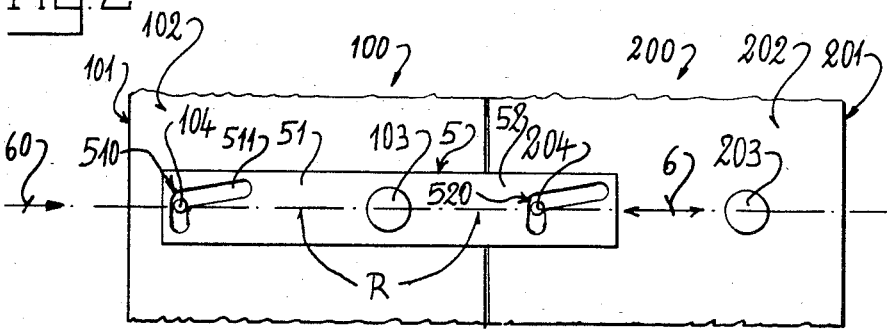
FIG. 2 is a bottom view of a part of the preferred embodiment shown on a different scale and illustrating specifically the lever and the extensions in the off-position of the two switch apparatuses.
Figure 3:
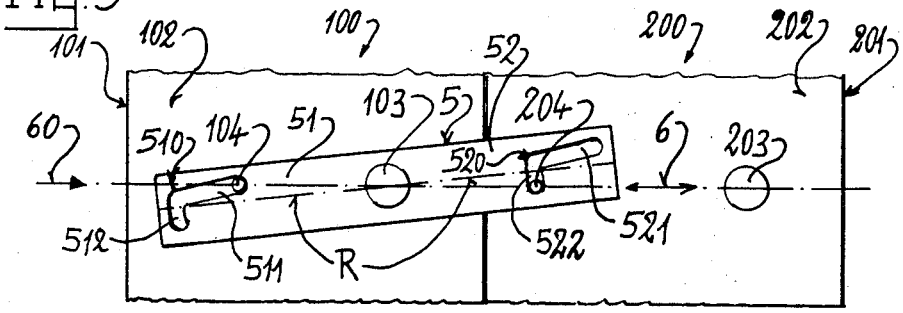
FIG. 3 is a view similar to FIG. 2 in which one switch apparatus is in its on-position and the other switch apparatus in its locked off-position.

If the armature 107 is pulled up (by the magnet), it will move the extension 104 from left to right, and accordingly the extension will slide along the path section 511 of the coulisse 510 extending at an acute angle relative to the direction of radius R of the lever and accordingly this lever 5 will be pivoted in a counterclockwise direction (according to the view of FIGS. 2 and 3). Conclusively, the extension 204 will be placed into the path section 522 of the coulisse 520, which extends curvilinearly around the stub 103 such that the extension 204 is immobilized and accordingly the switch apparatus 200 locked. Upon the energizing of the switch apparatus 1 the locking position illustrated in FIG. 3 will change back to the rest position illustrated in FIG. 2.

The operation generated by the pulling up of the armature 207 proceeds in an opposite manner, in such case the extension 204 located in the path section 521 of the coulisse 520 extending also at an acute angle relative to the direction of radius R would cause a pivoting movement of lever 5 in a clockwise direction such that now the extension 104 located in the path section 512 of the coulisse 510 extending curvilinearly around the stub 103 would blockingly lock the switch apparatus 100.

Accordingly, it is now possible to unite two similar relay switches having two similar extensions, one lever and one covering to two mutually mechanically lockable relay switches.

While there is shown and described a present preferred embodiment of the invention, it is to be distinctly understood that the invention is not limited thereto, but may be otherwise variously embodied and practiced within the scope of the following claims.

I claim:

1. A locking mechanism for a mutual interlocking of two switch apparatuses mounted in succession in a directly adjoining manner relative to their direction of switching movement, each apparatus having a casing, an armature and an outwards projecting extension movable by the armature during the switching operation of its switch apparatus, which extensions of the two apparatuses are operatively interconnected by a locking member, wherein the two switch apparatuses are arranged at an equidirectional closing direction of movement of their armature, and wherein said locking member comprises a two-armed lever which is pivotable about a pivot axis and is provided at both lever arms with one each of two reciprocally equidirectional L-shaped coulisses receiving each one of said extensions in a limited movable manner, whereby upon a closing movement of one of said switch its extension enters into one path section of its coulisse, pivots said lever around its pivot axis causing the other extension to enter into a path section of its coulisse extending at least such time perpendicularly to said direction of switching movement, wherein a path section of each coulisse is arranged extending along a circle extending around the pivot axis of the lever, and another path section of each coulisse extends at an acute angle relative to the direction of the radius of the lever.

2. The locking mechanism of claim 1, in which the lever is plugged over a stub shaft formed on the casing and held axially by a covering.

3. The locking mechanism of claim 2, in which the covering is held between an adjacing casing wall and a base onto latter both switching apparatuses are mounted.

4. The locking mechanism of claim 1, in which the lever is located at the outside of a casing wall forming the casing bottom.

5. The locking mechanism of claim 1, in which each extension is releasably mounted to its respective armature via an opening in the corresponding casing wall.

* * * * *